US005337430A

United States Patent [19]

Schlein

[11] Patent Number: 5,337,430

[45] Date of Patent: Aug. 16, 1994

[54] DEVICE FOR ASSISTING A PERSON TO TRANSFER INTO AND FROM A BED

[76] Inventor: Allen P. Schlein, 107 Curtis Ter., Fairfield, Conn. 06432

[21] Appl. No.: 54,404

[22] Filed: Apr. 28, 1993

[51] Int. Cl.[5] ..... A47C 21/00; A61G 7/00

[52] U.S. Cl. ..... 5/662

[58] Field of Search ..... 5/662, 81.1, 658, 503.1, 5/602

[56] References Cited

U.S. PATENT DOCUMENTS

| | | | |
|---|---|---|---|
| 1,778,698 | 10/1930 | Walter | 5/662 |
| 2,067,891 | 1/1937 | Comper | 5/602 |
| 5,060,327 | 10/1991 | Celestina et al. | 5/662 |
| 5,231,721 | 8/1993 | Fish | 5/662 |

OTHER PUBLICATIONS

"Arcorail" Transfer Bed Rail-Advertising brochures (3). Date of publication unknown. Arco Products, 265 Notre Dame Avenue, Winnipeg, Manitoba, Canada.

*Primary Examiner*—Alexander Grosz
*Attorney, Agent, or Firm*—Spencer E. Olson

[57] ABSTRACT

A support device adapted to be attached to a side rail of a bed frame for providing support to assist a person to get into and out of bed. The device includes a circular metal disk adapted to be attached to the side rail and an elongate handle of adjustable length pivotally connected at one end on a pivot pin which is anchored in and projects horizontally from the disk. The handle may be positioned either with vertical orientation in which it can be grasped by and provide support for the user, or with horizontal orientation alongside the side rail, out of the way and out of sight when not needed, by cooperation between a protrusion formed on the handle and detent slots formed in the disk.

9 Claims, 2 Drawing Sheets

DEVICE FOR ASSISTING A PERSON TO TRANSFER INTO AND FROM A BED

BACKGROUND OF THE INVENTION

This invention generally relates to apparatus and devices for providing postural support to humans, and, more particularly, to a device adapted for mounting on the side rail of a bed frame for assisting a person to get into and out of bed.

Among the many people who sometimes require assistance in getting into and out of bed are back pain sufferers who frequently experience excruciating pain, especially when lowering the upper torso the last eight or nine inches when getting into bed or raising the upper body the first eight or nine inches when trying to get out of bed. Experience has shown that the pain persists regardless of whether the attempt is made while lying on the side, on the back or on the stomach.

Often, the solution may be to rent an adjustable hospital bed by which the upper and lower torso can be raised out/or lowered, and which usually have an overhead trapeze which can be grasped for further assistance in maneuvering the body. However, because of the central placement of the trapeze relative to the edges of the bed it offers little help, and may actually interfere with the patient's attempt to lift the upper body and at the same time throw the legs over the edge of the bed to rest the feet on the floor. Moreover, a hospital bed in the home is anathema to elderly people, believing it would suggest to family and friends that the person's condition was more serious than is actually the case. Furthermore, it is costly to rent a hospital bed, and many insurance plans will not reimburse for more than three month's rental, factors which may lead to further patient anxiety.

Thus, a need exists for a low cost support device for assisting a patient with back pain to get into and out of bed. A straight forward technique which sometimes helps to ease the pain is to keep a quadruped cane at the bedside which because of its broad base provides a relatively stable structure which the patient can grasp for support and pull his or her upper torso up or down to assist while getting out of or into bed. However, because the lower end of the cane is not firmly anchored, its stability and, therefore, its effectiveness as a postural support, is limited. Since most people experience medical or nonmedical aging problems only periodically, and, therefore, do not require assistance at all times, the conventional quadruped cane offers the advantage that the patient can easily stow it away when not needed and return it to the bedside when he or she decides that support is needed. This is of importance to older people, most of whom aspire to live as independently as possible in their own homes, and who may be embarrassed by anyone seeing a device parked by the bedside, believing it would reveal his or her infirmity to family and friends.

A device which performs a function similar to that provided by a cane is manufactured by Arco Products, Winnipeg, Manitoba, Canada, and marketed under the trademark "ARCORAIL". It consists of a cane, one end of which rests upon the floor and is attached to the side rail of an angle iron bed frame to support it vertically. The cane is secured to the bed by a clamping system which includes a bar that extends across the bed and is clamped at opposite ends to the opposing side rails. The length of the bar is adjustable to accommodate use of the device on single, double or queen size beds. The cane is telescopic for convenient height adjustment.

While the ARCO device would appear to provide the desired assistance, it has the serious disadvantage that once installed on the bed it i s plainly visible, possibly causing embarrassment to the patient for the reasons discussed earlier, and, moreover, may actually interfere with the patient's arising from the bed during times when assistance is no longer needed. Also, the mounting bracket system is relatively cumbersome and heavy, weighing approximately eleven pounds, and therefore costly to manufacture and distribute.

A primary object of the present invention is to provide a support device for assisting a patent transfer to or from a bed which is adapted for attachment to a side rail of a bed and sufficiently low in cost to be affordable for patients to purchase instead of rent.

Another object is to provide a support device for assisting a patient while lying down or getting up from bed which would obviate the above-described shortcomings of available devices.

Another object of the invention is to provide a device adapted for easy attachment to a bed for providing assistance to a patient while getting into or up from the bed and which a patient can easily stow out of sight of others when not in use.

Yet another object is to provide a device for assisting a patient transfer to or from a bed which is lightweight yet sturdy, and can be manufactured at relatively low cost.

SUMMARY OF THE INVENTION

Briefly, the assisting device according to the invention comprises an elongate handle of adjustable length, one end of which is adapted to pivot on a pin which projects from a circular disk which, in turn, is adapted to be detachably secured to a side rail of a bed frame. In one embodiment, the disk is bolted to the side rail, and in an alterative construction the disk is bolted to a clamping mechanism which, in turn, is adapted to be clamped to the side rail at an adjustable position therealong.

The outwardly facing surface of the disk has three slots which extend inwardly from the periphery of the disk: one slot extends vertically, that is, perpendicularly to the side rail on which the disk is attached, and the other two are disposed at opposite ends of an imaginary line which passes through the pivot pin perpendicularly to the axis of the first slot. Each of these slots serves as a detent adapted to receive a protrusion formed on the handle whereby the handle may be selectively positioned either vertically or in either of two horizontal positions to adapt the device for use on either side of a bed. When assistance of the handle is required, the patient rotates the handle about the pivot pin from the horizontal position facing toward the head of the bed in which it normally would be "parked" to the vertical position, and then pushes down on the handle to drive the protrusion into the vertically oriented detent. When assistance of the device is not needed, or when the patient wishes to conceal the handle, the patient can, without help from others, lift the handle sufficiently to withdraw the protrusion from the vertical detent and rotate it about the pivot pin to a the horizontally oriented detent where it can be "parked" closely alongside the side rail where it can be concealed by the bedspread until again needed.

BRIEF DESCRIPTION OF THE DRAWINGS

Other objects, features and advantages of the invention will become apparent, and its construction and operation better understood, from the following detailed description when read in conjunction with the accompanying drawings, in which.

DESCRIPTION OF THE PREFERRED EMBODIMENTS

Figure 3:
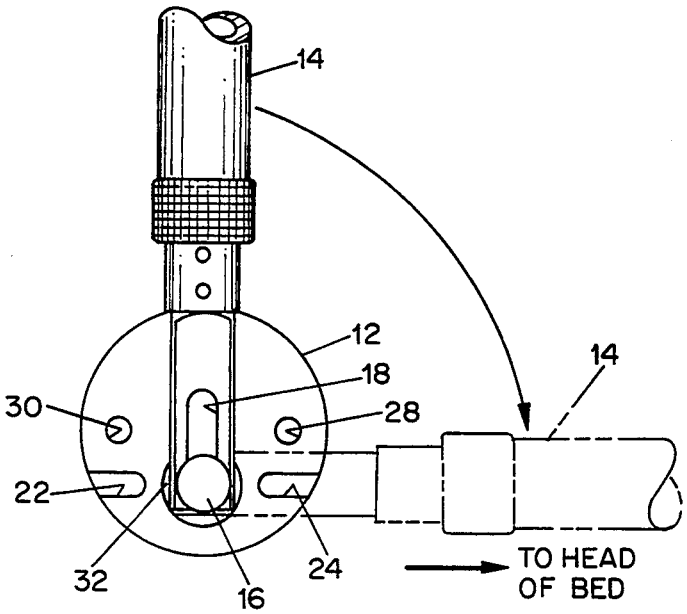
FIG. 3 is a front elevation view of the assisting device.
Figure 1:
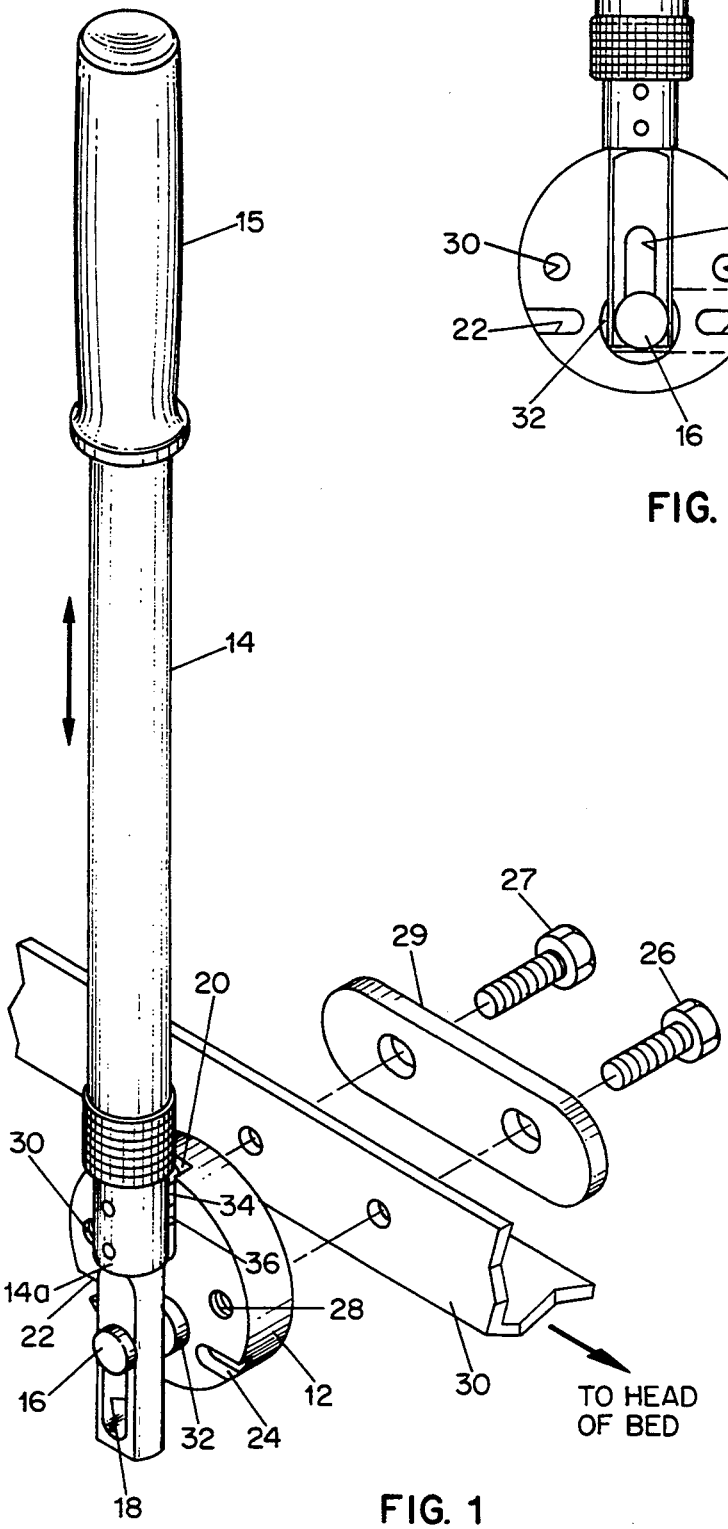
FIG. 1 is a perspective view of one embodiment of an assisting device constructed in accordance with the invention.
Figure 2:
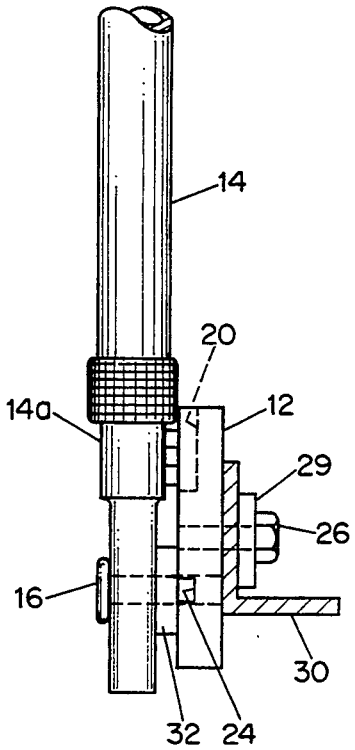
FIG. 2 is a fragmentary side elevation view of the assisting device of FIG. 1.

Referring to FIGS. 1 and 2 and 3, the assisting device includes a circular disk 12, preferably formed of a metal such as aluminum, and an elongate handle 14, one end of which is pivotally connected by a pivot pin 16 to the disk 12. The handle 14 is preferably hollow and of telescopic construction for convenient length adjustability, and a rubber grip 15 similar to the handle bar grips conventionally used on a bicycle handle bars is placed over the free end of the handle to cover any sharp edges and to facilitate gripping of the handle. Pivot pin 16 is preferably a steel rivet which extends through and is anchored in the disk 12 at a point located on a diameter of the disk at a location displaced from the center of the disk. The pin 16 projects perpendicularly from a flat surface of the disk and extends through an elongate slot 18 formed in the handle near the lower edge thereof. The width of slot 18 is slightly greater than the diameter of pivot pin 16 so as to allow free relative movement between the handle and the pivot pin, and has a length which permits a predetermined range of relative movement, to be described presently.

As best seen in FIGS. 1 and 3, the outwardly facing surface of disk 12 has three slots 20, 22 and 24 formed therein, each extending inwardly from the disk periphery; each may have a depth less than the thickness of disk 12 as shown, or they may extend completely through the disk. Slot 20 is disposed along, and its sides are parallel to, the diameter of the disk on which pivot pin 16 is located, and slots 22 and 24 are disposed at opposite ends of an imaginary line which passes through pivot pin 16 perpendicularly to the first-mentioned diameter. In this embodiment, disk 12 is detachably secured to the flat vertically-oriented outer surface of a side rail 30 of a bed frame of the angle iron type by a pair of bolts 26 and 27 which extend through holes drilled in a steel reinforcing plate 29 and aligned holes drilled in the side rail and threadably engage respective threaded holes 28 and 30 disposed on a diameter of the disk which is parallel to the aforementioned imaginary line which passes through slots 22 and 24. The plate 29 adds rigidity to the side rail. The disk is so oriented with respect to the side rail that slot 20 is vertically-oriented; that is, the disk is so designed that when it is attached to the bed rail in the manner described the axis of slot 20 is perpendicular to the long axis of the side rail 30.

Each of slots 20, 22 and 24 serves as a detent for receiving a protrusion formed on handle 14 for temporarily positioning the handle at one of three selected positions relative to the side rail to which the disk is attached. More specifically, a flattened lower portion **14*a* of handle 14, which may be a solid cylindrical rod secured within the lower end of the hollow handle, is spaced from the disk 12 by a flat washer-like spacer 32. The protrusion is in the form of a pair of pins 34, 36 secured at one end to, and extend radially outward from, the lower portion 14*a* of the handle in a direction parallel to the axis of pivot pin 16. The diameter of the pins is slightly less than the width of slots 20, 22 and 24 and they are sufficiently long so as to be received with a snug fit in any of the slots. The location of pivot pin 16 on the disk, the length and location of elongate slot 18 relative to the protrusion 34, 36 and the diameter of disk 16, are so related that when the pins 34, 36 are bottomed in a selected detent slot, the end of slot 18 nearest the protrusion firmly engages and is supported on pivot pin 16. The slot 18 is long enough to allow handle 14 to be axially moved a distance sufficient to withdraw the protrusion from the detent slot, as shown in FIG. 3**.

In operation, at times when the patient is out of bed, or has no immediate need for assistance, the handle 14 may be moved axially a distance sufficient to withdraw the protrusion from the detent in which it is then engaged, say, in slot 20, thereby to allow the handle to be rotated about pivot pin 16, clockwise or counter-clockwise depending upon which side of the bed the device is mounted, to the horizontally-oriented slot 22 or 24 facing the head of the bed. When the protrusion 34, 36 is aligned with the selected detent slot, say, slot 24 as depicted in FIG. 3, the handle is pushed inwardly relative to the pivot pin to cause the pins 34, 36 to enter and engage slot 24 whereby to "park" the handle 14 closely alongside and parallel to the side rail so as to be completely out of the way and where, if desired, it can be covered by the bedspread until it may again be needed. The operation of moving the handle from one position to another is so simple and requires so little exertion that in most cases it can be performed by the patient without assistance.

Should the patient require the assistance of the handle, say to get into bed, he or she simply moves the handle axially to withdraw the protrusion from the detent slot at which the handle was "parked", moves it to the vertical position, and pushes it axially downward to drive the protrusion into the vertically-oriented slot 20 to securely anchor the lower end of the handle to the disk, and thus to the bed frame. After adjustment to a desired length the handle can be grasped by the patient to give firm and secure support while getting into bed. Once in bed, the patient may choose to leave the handle in its vertical position, in which it offers some security against falling out of bed, or he or she may wish to "park" it in the horizontal position until it is again needed.

Figure 4:
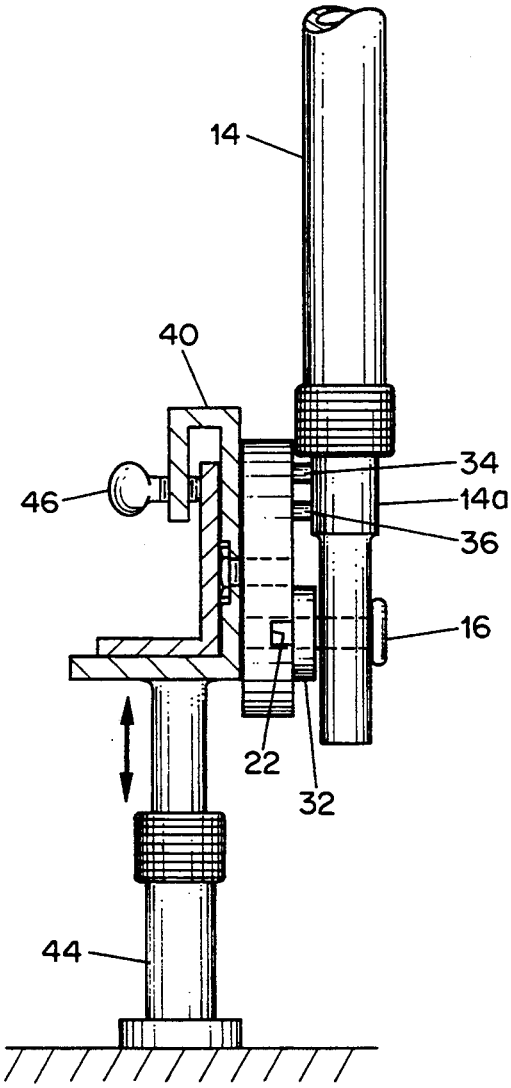
FIG. 4 is an elevation view of an alternative embodiment of the invention shown clamped to a side rail of a bed fame.

Instead of bolting the disk to the side rail, and thereby avoid the inconvenience of drilling holes in the side rail, the disk may be bolted to a clamp 40, as shown in FIG. 4, which, in turn, is adapted to be clamped onto the bed frame 42. The clamp has essentially the same cross-sectional shape as the bed frame so as to fit snugly over the side rail and has a length at least equal to the diameter of the disk 12. A leg 44 of adjustable length is integral with and depends from the underside of clamp 40 which rests on the floor to provide added support to the side rail. During placement of the clamp on the side rail, the leg 44 is shortened to allow the handle 14 to be tilted to the left, as viewed in FIG. 4, thereby to allow the U-shaped upper portion of the clamp to be dropped over the upper edge of side rail 42. The clamp allows the assisting device to be easily moved back and forth along the side rail to a location determined by the patient to be most comfortable, at which it is secured by a thumb screws 46 threaded in the clamp and engaging the side rail 42. The clamp gives the patient the independence of attaching the device to the bed rail instead of having to request the aid of a family member to drill the holes required for bolting the disk to the bed frame.

Figure 5:
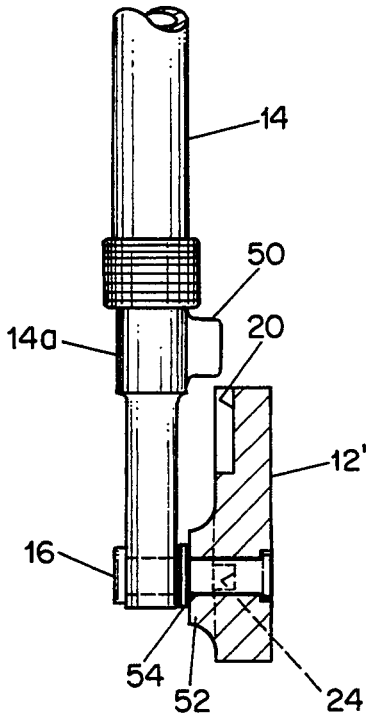
FIG. 5 is a side elevation view illustrating an alternative construction of a portion of the assisting device.

An alternative construction of the lower end portion 14*a* of the handle shown in FIG. 5 consists essentially of a single cylindrical piece wherein the pins 34, 36 are replaced by a protuberance 50 having a size and shape to be received in a selected one of slots 20, 22 or 24. FIG. 5 also illustrates an alternative construction of the disk 12', differing in that it has an integral annular flat 52 which surrounds the pivot pin 16 and serves the same function as that of the spacer 32 in the FIG. 1 embodiment, namely, to provide a space between the handle and disk so as to allow free rotational movement of the handle relative to the disk. To avoid metal-to-metal contact between the lower end of the handle and the annular surface of the flat 52, a thin washer 54 formed of a suitable material such as Teflon is placed between them. The alternative disk 12' with annular flat 52 can readily be formed by extrusion and, therefore, can be fabricated less expensively than the corresponding functional elements of the FIG. 1 embodiment.

While specific embodiments of an improved assisting device have been described, it will be understood that various modifications within the spirit of the invention may occur to those skilled in the art. Therefore, it is intended that no limitations be placed on the invention except as defined by the scope of the appended claims.

I claim:

1. A support device adapted to be anchored to a bed side rail for providing support to assist a person to get into or out of bed, said support device comprising:

a flat, circular disk, a pivot pin anchored at one end to said disk and projecting from a first surface thereof, means for detachably securing said disk to a side rail of a bed frame such that said pivot pin extends horizontally, an elongate handle having first and second ends pivotally connected at said first end to said pivot pin for rotation relative to said disk in a plane parallel to said first surface, and detent means including at least two slots formed in and arranged along the periphery of said first surface of said disk and a protrusion projecting from said handle at a location to be engageable with said slots for selectively positioning said handle either with vertical orientation in which it can be grasped by and provide support for a person getting into or out of bed or with substantially horizontal orientation alongside said bed side rail out of the way.

2. A support device according to claim 1, wherein said disk has first, second and third slots formed therein, and wherein said first slot is located at a first end of a first diameter of said disk which is vertically-oriented when said disk is secured to said bed rail, and wherein said second and third slots are angularly displaced in opposite directions from said first slot and located at opposite ends of an imaginary line perpendicularly intersecting said first diameter and passing through the location at which said pivot pin is anchored.

3. A support device according to claim 2, wherein said disk has first and second threaded holes formed therein near opposite ends of a disk diameter which is perpendicular to said first disk diameter, and wherein said means for detachably securing said disk to a side rail of a bed frame comprises a pair of threaded bolts passing through holes drilled in said side rail and threadably engaging the threaded holes in said disk.

4. A support device according to claim 2, wherein said disk has first and second threaded holes formed therein near opposite ends of a disk diameter which is perpendicular to said first diameter, and wherein said means for detachably securing said disk to a side rail of a bed frame comprises a clamp having a cross-sectional shape and size adapted to engage said side rail, and a pair of threaded bolts passing through holes drilled through said clamp and threadably engaging the threaded holes in formed said disk.

5. A support device according to claim 2, wherein a grip is affixed to said second end of said handle for facilitating grasping of the handle by a patient, wherein the length of said handle is adjustable, and wherein said handle has an elongate slot formed therein near said first end for receiving said pivot pin and allowing said handle to be moved along its long axis relative to said pivot pin between a first position at which said protrusion is engaged in a selected slot and a second position at which said protrusion is out of engagement with a slot and the handle is freely rotatable relative to said disk.

6. A support device according to claim 1, wherein the length of said handle is adjustable, and wherein a grip is affixed to said second end thereof for facilitating grasping of the handle.

7. A support device according to claim 1, wherein said first end of said handle has an elongate slot formed therein for receiving said pivot pin and allowing said handle to be moved axially relative to said pivot pin between a first position at which said protrusion is engaged in a selected slot and a second position at which said protrusion is out of engagement with a slot and said handle is freely rotatable relative to said disk.

8. A support device according to claim 7, wherein said device further comprises means for spacing said handle rom said disk.

9. A support device according to claim 8, wherein said means for spacing comprises an annular flat formed on said first surface of said disk and surrounding said pivot pin.

* * * * *